United States Patent [19]

Kredo

[11] 4,118,766

[45] Oct. 3, 1978

[54] FLUORESCENT LIGHT FIXTURE

[75] Inventor: Theodore A. Kredo, Torrance, Calif.

[73] Assignee: California Precision, Torrance, Calif.

[21] Appl. No.: 705,754

[22] Filed: Jul. 15, 1976

[51] Int. Cl.[2] ..... A47F 5/00; H05B 33/02

[52] U.S. Cl. ..... 362/427; 248/284

[58] Field of Search ..... 240/10 R, 25, 51.11 R, 240/52 R, 52 BL, 67, 70, 73 BA, 73 BJ, 2 D, 4; 248/284; 151/38, 68; 362/418, 419, 427, 382

[56] References Cited

U.S. PATENT DOCUMENTS

| | | | |
|---|---|---|---|
| 1,326,650 | 12/1919 | Doerr | 248/284 |
| 1,467,815 | 9/1923 | Roemer | 151/68 UX |
| 2,131,708 | 9/1938 | Lesperance | 240/2 D |
| 2,434,986 | 1/1948 | Bremer | 248/284 X |
| 2,936,805 | 5/1960 | Rice | 151/38 |
| 3,086,107 | 4/1963 | Grover | 240/52 R |
| 3,110,446 | 11/1963 | Rathbun | 240/73 BA |
| 3,188,460 | 6/1965 | Thorsen et al. | 240/52 R |
| 3,601,598 | 8/1971 | Horn | 240/52 R |
| 3,652,848 | 3/1972 | Miller et al. | 240/51.11 R X |

FOREIGN PATENT DOCUMENTS

| | | | |
|---|---|---|---|
| 378,418 | 7/1964 | Switzerland | 240/52 R |

*Primary Examiner*—Donald A. Griffin

*Attorney, Agent, or Firm*—Booker T. Hogan, Jr.

[57] ABSTRACT

An improved fluorescent light fixture having a multiple disc pivot joint tensioning system and a pretensioned second pivot joint system, both of which provide the capability of maintaining a uniform light intensity on a working surface is disclosed. The light fixture is also capable of maintaining its orientation with respect to the working surface on which it is mounted independently of the attitude orientation of the working surface.

10 Claims, 6 Drawing Figures

FIG. 5
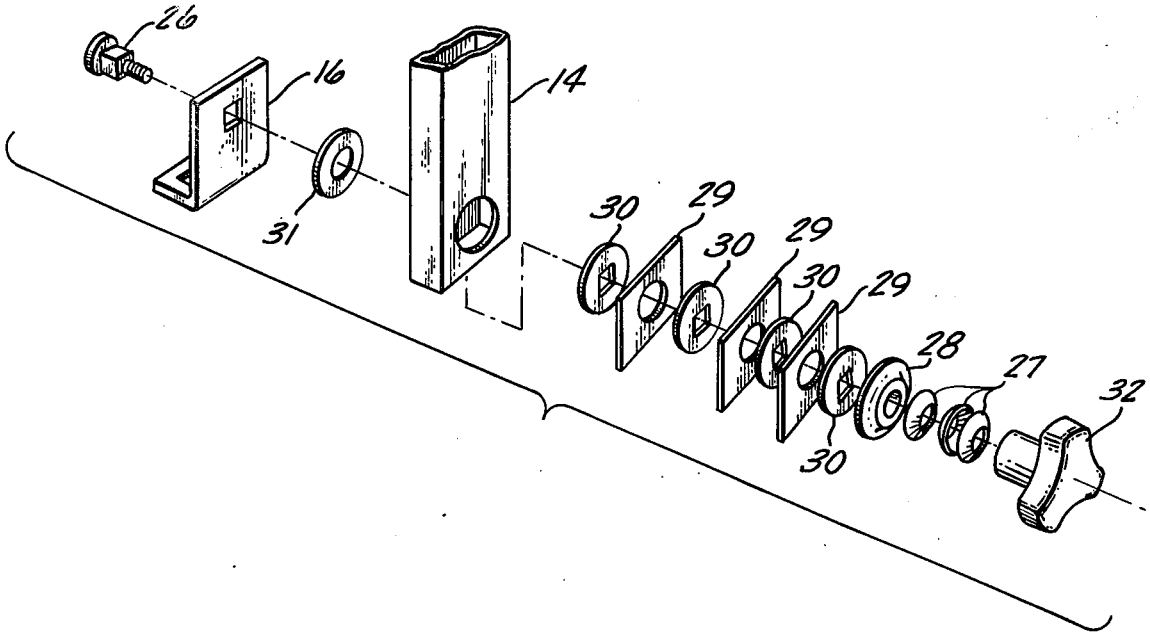
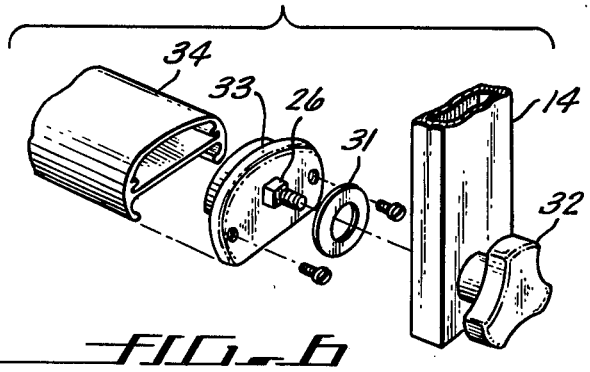
FIG. 6
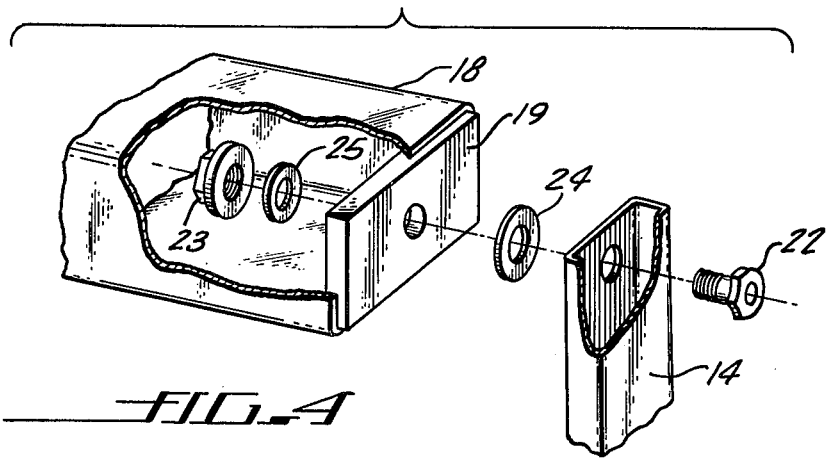
FIG. 4

FLUORESCENT LIGHT FIXTURE

BACKGROUND OF THE INVENTION

The background of the invention will be set forth in two parts as follows:

1. Field of the Invention

The invention relates to the field of lighting fixtures in general and to lighting fixtures that have hood assemblies which are adjustable with respect to the surface upon which they are mounted in particular.

2. Description of the Prior Art

In lighting applications, where a large working surface such as a drafting board or an electronic assembly bench is to be illuminated, one of the problems encountered is the difficulty of providing uniform illumination of the working surface. This problem is particularly acute in the case of drafting boards where the length of the board may exceed 10 feet. Also, the orientation of the board may change and disturb the uniformity of the illumination.

In the past light fixtures of various designs have been used to provide the desired lighting intensity on the working surface, particularly when the overhead lighting such as found in drafting rooms do not provide sufficient light intensity on the working surface. These light fixtures are either mounted directly on the working surface or mounted in the vicinity of the working surface. Typical of these devices are Trombolite Fixtures, manufactured by Fostoria Industries, Inc., The Floating Arm Fluorescent Lamp Fixture, manufactured by Dazor Manufacturing Corporation; the FL series fluorescent lamp and the B series lamp both of which are manufactured by Luxo Company.

Although all the foregoing devices allow for adjustment of the position of the light source with respect to the working surface, none of them provide a uniform illumination of the working surface, particularly large working surfaces. The Trombolite fixtures and the B series lamps utilize incandescent light sources housed in circular hoods whose inner surfaces function as reflectors. A concentrated cone of light is emitted which tends to illuminate only a relatively small area.

The Floating Arm fixture and the FL series lamp both utilize fluorescent light sources housed in a logitudinal hood assembly which also acts as a reflector. The illumination provided by these devices tends to be more uniformly distributed than those where the light source is a conventional light bulb and a circular hood is used as the reflector. However, because the length of the fluorescent lamps extend only over a fraction of the length of the working surface, the desired uniform illumination is not provided.

A lighting appliance, invented by L. C. Doane (U.S. Pat. No. 2,092,573) contains a hood assembly which extends over the entire length of the surface to be illuminated. The Doane device is, however, limited as to length of the hood assembly, because the excessive weight of a long assembly coupled with the additional weight required by the arm pivot system which utilize a strap device for the pivot system. The difficulty in supporting the excessive weight required by very long hood assemblies with a suitable pivot joint system is typical of prior art fluorescent light fixtures including the Doane device.

As previously indicated, another problem with most prior art light fixtures, including the Doane device, is that the uniformity of illumination is disturbed with a change in orientation of the working surface. The orientation of hood assembly is upset when the working surface is rotated or translated, as in the case of modern drafting tables, which have the capability of rotating the working surface to a vertical position plus the capability of adjusting the height of the work surface. The Trombolite fixture attempts to provide the capability of maintaining the position of the light source independent of the orientation of the working surface, by mounting the device on a horizontal arm of the drafting machine. The disadvantage of this device is that the lamp travels together with the arm of the drafting machine and tends to upset the adjustment of the drafting machine when the lamp is adjusted to various positions. This adjustment is necessary because of the limited area of the illumination provided by this device.

SUMMARY OF THE INVENTION

In view of the problems heretofore set forth and the characteristics of the prior art, it is the primary object of this invention to provide a new and improved fluorescent light fixture capable of providing a uniform diffused illumination on a large working surface such as a drafting table.

Another object of this invention is to provide a new and improved fluorescent light fixture capable of providing uniform illumination with a minimum of adjustment.

Still another object of this invention is to provide a new and improved fluorescent light fixture capable of directing uniform illumination to any desired area of the working surface.

Still another object of this invention is to provide a new and improved fluorescent light fixture capable of being mounted to the working surface to be illuminated and which is capable of maintaining the position of the light source relative to the working surface independent of the orientation of the working surface.

Still another object of this invention is to provide a new and improved fluorescent light fixture which can be easily adjusted in accordance with the illumination requirements.

A further object of this invention is to provide a new and improved fluorescent light fixture which is relatively simple to fabricate.

In seeking to achieve the foregoing objectives while avoiding the disadvantages of the prior art, a new and improved light fixture is provided which is capable of providing diffused uniform illumination on a large working surface, and in which the uniform illumination can be directed to any desired area of the working surface by rotation of the hood assembly and the arm. The fixture extends over the length of the working surface and can be mounted on the working surface. The orientation of the light source with respect to the working surface is not disturbed when the working surface is rotated or translated.

The light fixture is comprised of a hood assembly, two arms, two pretensioned pivot joint systems, two multiple disc pivot joint tensioning systems, and means for mounting said fixture to a working surface such as a drafting table.

The hood assembly houses the fluorescent bulb and reflects the light through a prismatic diffuser.

Each pretensioned pivot joint system, which rotatably connects the hood assembly to one end of an arm, is comprised of a conduit nipple having a predetermined shank length, a conduit bushing having a predetermined depth, at least one fiber friction washer having a predetermined thickness and at least one spring washer having a predetermined thickness tension. The conduit nipple extends through an opening disposed on one end of the arm through the fiber friction washer, through a hood cap, which is a part of the hood assembly, through the spring washer and then engages the conduit bushing, thus rotatably connecting the hood assembly to the arm. The selected pretension on the pivot joint is obtained when the conduit nipple fully engages the predetermined depth of the conduit bushing.

The multiple disc pivot joint tensioning system, which rotatably connects the other end of the arm to the working surface at a connection point, such as a bracket, is comprised of a pivot arm axle, a spring means, alternately disposed rotating and stationary friction washers, at least one transition washer, a spacer, and a spring tensioning means. The pivot axle extends through an opening on the mounting surface connecting means, such as a bracket, through a spacer, through an opening disposed on the other end of the arm, through the rotating and stationary washers, through the transition washer, through the spring means and then engages the spring tensioning means, thereby rotatably connecting the arm to the working surface. Proper tensioning of the pivot joint is obtained by adjusting the spring tensioning means.

BRIEF DESCRIPTION OF THE DRAWING

FIG. 4 is an exploded view of a section of the light fixture illustrating the pretensioned pivot joint system;

FIG. 5 is an exploded view of a section of the light fixture illustrating the multiple disc pivot joint tensioning system; and FIG. 6 is a section of another embodiment of the light fixture wherein the arm is connected to a horizontal member of a drafting machine.

DESCRIPTION OF THE PREFERRED EMBODIMENT

Figure 1:
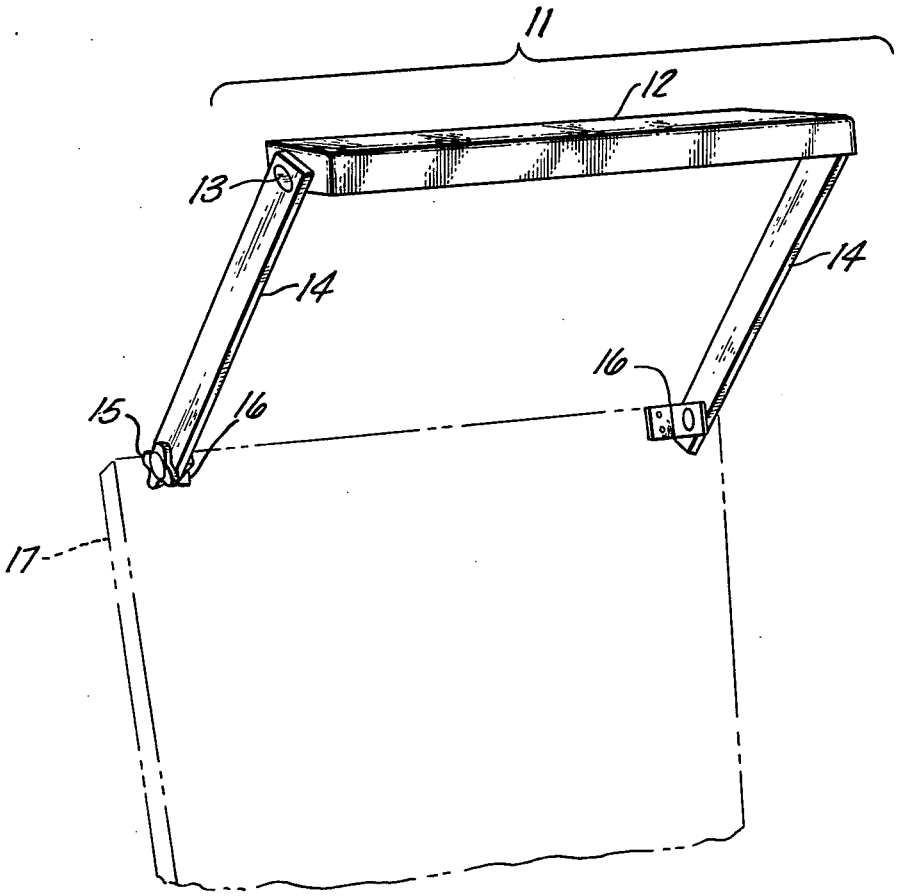
FIG. 1 is a perspective view of the fluorescent light fixture in accordance with one embodiment of the present invention.

Referring now to the drawing in FIG. 1, there is shown a fluorescent light fixture 11, in accordance with one embodiment of the present invention, comprising a hood assembly 12, rotatably connected by a first pivot joint system 13 to the first end of each arm 14. The second end of each arm 14 is rotatably connected by a second pivot joint system 15 to a mounting means, such as a bracket 16, which is mounted on a working surface 17. Although a bracket 16 is selected as the mounting means, other parts of the working surface 17 may be utilized as will be shown in another embodiment of this invention.

Figure 2:
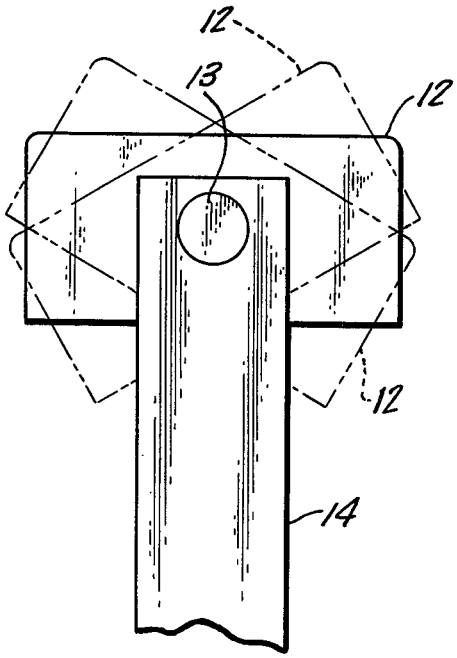
FIG. 2 is a side view of a section of the fluorescent light fixture illustrating the rotation of the hood assembly.

The fluorescent light element (not shown) is housed within the hood assembly 12 which also acts as a reflector and cooperates together with the light element as the light emanating source. The position of the light source, comprising of the fluorescent light element and the reflective surface of the hood assembly 12, with respect to the working surface 17 may be adjusted by rotating the arm 14 about the second pivot joint system 15 and rotating the hood assembly 12 about the first pivot joint system 13. The rotation of the hood assembly 12 about the first pivot joint system 13 is shown by dashed lines in FIG. 2.

Figure 3:
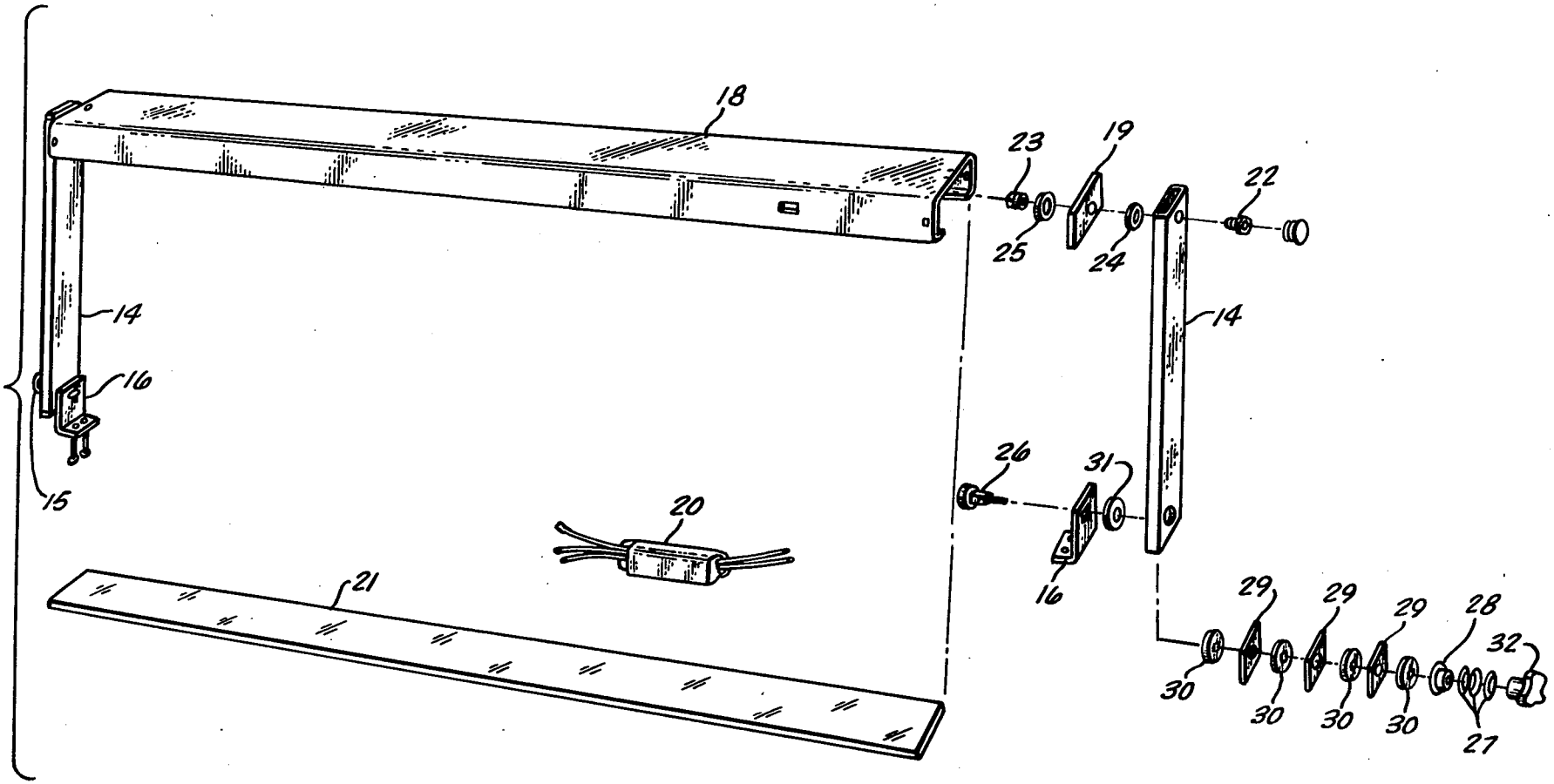
FIG. 3 is an exploded view of a section of the fluorescent light fixture shown in FIG. 1 which depicts the various elements comprising the fixture.

Referring to FIG. 3, there is shown an exploded view of the elements comprising the embodiment shown in FIG. 1. The hood assembly is comprised of a hood 18, two hood caps 19, a ballast 20, at least one fluorescent light element (not shown) and a diffuser 21. Any lightweight structural material having a highly reflective surface may be employed to fabricate the hood 18. Aluminum is a preferred material because of its low cost, light weight and good surface characteristics. The diffuser may be fabricated from any of a multiplicity of transparent material such as glass and clear prismatic plastic. The latter is preferred because it is light in weight and shatterproof.

Arms 14 provide a means for holding the hood assembly in a selected spaced relation to a working surface. The arms 14 may be fabricated from any material, preferably metal, such as aluminum. An arm of tubular construction, preferably having a rectangular cross section, provides a structural member which is light in weight in comparison to its load carrying capability. In addition a rectangular cross sectional arm facilitates the installation and design of the pivot joint systems, as will be shown below.

The first pivot joint system 13 (see FIG. 1), described herein as a pretensioned pivot joint system, rotatably connects the hood assembly to one end of the arm 14. It is comprised of a conduit nipple 22 having a predetermined shank length, a conduit bushing 23 having a predetermined depth, at least one fiber friction washer 24 having a predetermined thickness and at least one spring washer 25 having a predetermined thickness and tension. Referring to FIG. 4, which shows the pretensioned pivot joint system 13 in greater detail, it can be seen that the predetermined shank length of the conduit nipple 22 extends through an opening on one end of the arm 14, through the fiber friction washer 24, through the hood cap 19, through the spring washer 25, and then engages the conduit bushing 23, thereby connecting the hood assembly 12 to the arm. The desired pretension on the pivot joint system 13 is thus achieved when the conduit nipple 22 fully engages the conduit bushing 23 to its predetermined depth. With a proper selection of the thickness of the washers 24 and 25, no further adjustment of the tension on the pivot joint is required.

The conduit nipple 22 and the conduit bushing 23 may be fabricated from a suitable metallic material such as aluminum or steel. The spring washer 25 may be fabricated from a suitable metallic material having good spring characteristics such as spring steel. The friction washer 24 may be fabricated from either a non-metallic material such as hard fiber or a metallic material such as steel. A non-metallic material is preferred over a metallic material because the friction and wear resistance characteristics of non-metallic washers such as hard fiber are superior to metallic washers. Furthermore, non-metallic washers are economical.

Referring again to FIG. 3, there is shown an exploded view of the second pivot joint system 15 herein described as the multiple disc pivot joint tensioning system. The multiple disc pivot joint tensioning system 15 rotatably connects the other end of the arm to a mounting means such as a bracket 16, which is attached to the working surface. It is comprised of a pivot arm axle 26, a spring means 27, at least one transition washer 28, a multiplicity of alternately disposed rotating friction washers 29 and stationary washers 30, at least one spacer 31, and a spring tensioning means 32.

Referring to FIG. 5, it can be seen that the pivot arm axle 26 extends through an opening disposed on the mounting means 16, through the spacer 31 used to separate the arm 14 from the connecting means 16, through an opening on one end of the arm 14, through the rotating washers 29 and the stationary friction washers 30, through the transition washer 28, through the spring means 27, and then engages the spring tensioning means 32, thereby connecting one end of the arm 14 to the mounting means 16.

The pivot arm axle 26 may be described as a bolt having a head, a non-circular first portion and a circular threaded second portion or end. It may be fabricated from any suitable hard material. Steel is a preferred material.

The rotating friction washers 29 are rectangular in shape having predetermined dimensions so that they can be contained within the arms 14 and thus rotate with the arms 14. Within each rotating friction washer 29 is disposed a hole preferably circular of sufficient diameter to allow the washer to freely rotate about the non-circular portion of the pivot arm axle.

The stationary washers 30, preferably circular in shape are of sufficient dimension so as to be containable within the arms 14. Within each stationary friction washer 30 is disposed a hole, preferably square, of sufficient size to allow the stationary washer 30 to closely fit over the non-circular portion of the pivot arm axle 26 preferably square in cross section. As the arm 14 is rotated about the pivot arm axle 26 the rotating washers 29 rotate about the pivot arm axle 26 together with arm 14. The stationary friction washers 30 are restrained by the pivot arm axle 26. The spring means 27 provide the required pressure between the rotating friction washers 29 and the stationary washers 30 to obtain the desired frictional contact force between the two types of washers. The pressure on the washers is obtained by adjusting the spring tensioning means 32.

The spring tensioning means 32 may be described as a knob having an internally threaded shaft adapted for receiving the threaded portion of the pivot arm axle 26. It may be fabricated from any metallic or hard plastic material.

While a combination of one stationary friction washer 29 and one rotating friction washer 30 is adequate to provide the required friction contact, a combination of a multiplicity of rotating and stationary washers is preferable. A combination comprised of a multiplicity of rotating and stationary washers allows for a more sensitive adjustment of the pivot joint system 15 because the frictional forces are distributed over a greater contact area. Furthermore, there is less wear on the contact surfaces.

The washers may be fabricated from a non-metallic material or a metallic material. The preferable combination is to utilize a non-metallic rotating washer 29 made from hard fibre and metallic stationary washers 30 made from steel. This combination provides the most desirable friction and wear characteristics. Furthermore, hard fiber washers are more economical than metallic washers. Although the foregoing combination is preferred, other combinations are suitable but with less desirable results.

The spring means selected is a multiplicity of spring washers, although other spring means may be suitable. While one spring is adequate to provide the spring means, a multiplicity of springs is desirable. A multiplicity of spring washers installed in series, apex to apex and base to base, provides a greater travel for the same force applied to the spring means 27 by the spring tensioning means 32, allowing for greater sensitivity in the adjustment of the joint tensioning system 15. The greater the number of spring washers the more sensitive the adjustment becomes. The number of springs washers usually giving the most desirable adjustment sensitivity is approximately three to four spring washers. Once a desired spring tension of the joint tensioning system 15 is selected, the tension remains at essentially the same level. No adjustment is usually necessary.

The force applied via the spring tensioning means 32 to the spring means 27 is transmitted to the frictional washers by a transition washer 28 which resembles a hat with a hole on the top. The top portion of the washer is contacted by the spring means. The forces applied thereby are transmitted by the rim section of the washer to the frictional washers which are compressed about the non-circular portion of the pivot arm axle 26. The transition washer may be any hard material, preferably steel.

Referring to FIG. 6, there is shown another embodiment of the present invention wherein the arm 14 is connected to a cap 33 suitable for attachment to a horizontal drafting machine 34. In this embodiment the bracket 16 is eliminated as a mounting means.

Having fully disclosed how to use and how to make my invention, the scope of my claims may now be understood to be as follows:

I claim:

1. An improved fluorescent lamp fixture having a hood assembly comprised of at least one fluorescent light element and a means for holding said element in a space relationship to a reflective means formed on the inner surface of said assembly where said assembly is connected to at least two spaced means each having a first and second end for maintaining said assembly in a spaced relationship with respect to a surface and a connecting means for connecting said spaced means to said surface, the improvement comprising the disposition of a ballast within said hood assembly, a pretensioned pivot joint system rotatably connecting said hood assembly to first end of said spaced means and multiple disc pivot joint tensioning systems rotatably connecting said second end of said spaced means to said connecting means.

2. The fixture of claim 1 wherein said space means is a tubular structure.

3. The fixture of claim 2 wherein said structure has a rectangular cross section.

4. The fixture of claim 1 wherein said pretensioned pivot joint system is comprised of a conduit nipple, having a predetermined shank length, which extends through; an opening disposed within said first end of said space means; at least one friction washer; an opening in a hood cap; and at least one spring washer, into a conduit bushing having a predetermined depth.

5. The fixture of claim 4 wherein said multiple disc pivot joint tensioning system is comprised of a means for applying tension to a spring means about a pivot arm axle which extends through; alternately disposed rotating and stationary friction washers; at least one transitional washer; and at least one spacer to connect said second end of said space means to said connecting means, wherein said pivot arm axle is comprised of a non-circular first portion followed by a threaded second portion adapted to receive said means for applying tension, wherein said rotating frictional washers are comprised of solid materials having at least two parallel sides and a circular hole disposed therein adapted to accommodate said axle, and wherein said stationary washers are comprised of circular solid materials having non-circular holed disposed therein adapted to accomodate said axle.

6. The fixture of claim 5 wherein said spring means is comprised of at least one spring washer and said frictional washers is comprised of at least one stationary washer and at least two rotating washers.

7. The fixture of claim 6 wherein said space means is a tubular structure having a rectangular cross section.

8. The fixture of claim 1 wherein said connecting means is an end cap adapted for attachment to the horizontal member of a drafting machine.

9. A multiple disc pivot joint tensioning system suitable for maintaining a first member of a lighting fixture for a drafting lamp in a fixed relationship with respect to a second member of said fixture comprising, a pivot arm axle having a head, a non-circular first portion and a circular threaded end, a series of alternating stationary and rotational friction discs disposed on said axle, whereby said rotational discs are adapted to rotate with said first member and said stationary discs are adapted to conform to said non-circular first portion of said axle and thereby maintain a fixed relationship with respect to said axle, at least one transitional washer and a spring means disposed on said axle for compressing said discs and a spring tensioning means adapted for receiving said threaded end of said axle and biasing the tension of said spring means.

10. The joint system of claim 9 wherein said axle contains a non-circular first portion adapted to restrain said stationary friction washers followed by a threaded second portion or end adapted to receive said spring tensioning means.

* * * * *